US009227825B2

(12) United States Patent
Wulstein

(10) Patent No.: US 9,227,825 B2
(45) Date of Patent: Jan. 5, 2016

(54) BOTTLE COUPLING DEVICE

(71) Applicant: Daniel Wulstein, Hesperia, CA (US)

(72) Inventor: Daniel Wulstein, Hesperia, CA (US)

( * ) Notice: Subject to any disclaimer, the term of this patent is extended or adjusted under 35 U.S.C. 154(b) by 0 days.

(21) Appl. No.: 14/285,580

(22) Filed: May 22, 2014

(65) Prior Publication Data

US 2014/0345744 A1 Nov. 27, 2014

Related U.S. Application Data

(60) Provisional application No. 61/826,182, filed on May 22, 2013.

(51) Int. Cl.
*B65B 1/04* (2006.01)
*B67C 9/00* (2006.01)

(52) U.S. Cl.
CPC ..... *B67C 9/00* (2013.01)

(58) Field of Classification Search
CPC ..... B67C 9/00
USPC ..... 141/319, 331, 363–366, 368
See application file for complete search history.

(56) References Cited

U.S. PATENT DOCUMENTS

| | | | | |
|---|---|---|---|---|
| 3,156,272 | A * | 11/1964 | Indrunas | 141/286 |
| 5,884,678 | A * | 3/1999 | Chudy | 141/319 |
| 6,470,928 | B1 * | 10/2002 | Davis et al. | 141/364 |
| 7,347,459 | B2 * | 3/2008 | Geary et al. | 285/390 |

* cited by examiner

*Primary Examiner* — Jason K Niesz
(74) *Attorney, Agent, or Firm* — Ruth Eure

(57) ABSTRACT

A bottle coupling device for connecting a first bottle to a second bottle is provided. The first bottle has a first threaded opening and the second bottle has a second threaded opening. The first bottle holds a first substance and the second bottle holds a second substance. The bottle coupling device comprises a hollow female coupling having an outer surface and an inner surface with a first end and a second end. The inner surface of the first end and the second end are threaded. The first opening of the first bottle is threadably connectable to the first end of the female coupling and the second opening of the second bottle is threadably connectable to the second end of the female coupling. Wherein the second substance is transferrable to the first bottle through the female coupling.

12 Claims, 2 Drawing Sheets

BOTTLE COUPLING DEVICE

The present application claims the benefit of priority of pending provisional patent application Ser. No. 61/826,182, filed on May 22, 2013, entitled "Bottle Coupling".

BACKGROUND OF THE INVENTION

1. Field of the Invention

This invention relates generally to a bottle coupling device and, more particularly, the invention relates to a bottle coupling device providing a threaded, open ended coupling configured to easily connect two bottles together thereby serving as a funnel through which the remnants of various household products can be easily transferred from a nearly empty container to one which can be topped off.

2. Description of the Prior Art

Learning the value of saving money is of key importance to anyone who wishes to lead a successful and comfortable life. An extremely popular way in which people save money is by undergoing simple steps to prevent unnecessary waste. Making sure to turn off lights when leaving a room in order to save a few dollars on an electric bill, scraping the last few dollops of peanut butter out of the jar before tossing it in the trash to prevent food waste, or dampening a mascara wand with a few drops of water in order to extend the life of an expensive cosmetic, taking steps to prevent waste can result in extra money to pay for an unexpected auto repair, or even a night out with friends.

SUMMARY

The present invention is a bottle coupling device for connecting a first bottle to a second bottle. The first bottle has a first threaded opening and the second bottle has a second threaded opening. The first bottle holds a first substance and the second bottle holds a second substance. The bottle coupling device comprises a hollow female coupling having an outer surface and an inner surface with the female coupling having a first end and a second end. The inner surface of the first end and the second end are threaded. The first opening of the first bottle is threadably connectable to the first end of the female coupling and the second opening of the second bottle is threadably connectable to the second end of the female coupling. Upon threadably connecting the first threaded opening of the first bottle to the first end of the female coupling and the second threaded opening of the second bottle to the second end of the female coupling, the second substance is transferrable to the first bottle through the female coupling.

In addition, the present invention includes a method for connecting a first bottle to a second bottle. The first bottle has a first threaded opening and the second bottle has a second threaded opening. The first bottle holds a first substance and the second bottle holds a second substance. The method comprises providing a hollow female coupling having an outer surface and an inner surface with the female coupling having a first end and a second end, threading the first end of the inner surface of the first end, threading the second end of the inner surface of the second end, threadably connecting the first opening of the first bottle to the first end of the female coupling, threadably connecting the second opening of the second bottle to the second end of the female coupling, and transferring the second substance to the first bottle through the female coupling.

The present invention further includes a bottle coupling device for connecting a first bottle to a second bottle. The first bottle has a first threaded opening and the second bottle has a second threaded opening. The first bottle holds a first substance and the second bottle holds a second substance. The bottle coupling device comprises a hollow female coupling having an outer surface and an inner surface with the female coupling having a first end and a second end. The inner surface of the first end is threaded and the inner surface of the second end is threaded. The first end of the female coupling is the same size as the second end of the female coupling with the threads of the first end and the second end of the female coupling being the same. A hollow male coupling is provided having an outer surface and an inner surface with the male coupling having a first end and a second end. The inner surface and the outer surface of the first end of the male coupling are threaded and the inner surface and the outer surface of the second end of the male coupling are threaded. The first end of the female coupling is connectable to the first threaded opening of the first bottle, the first end of the male coupling is connectable to the second end of the female coupling, and the second end of the male coupling is connectable to the second threaded opening of the second bottle. The second substance is transferrable to the first bottle through the connected female and male coupling.

DETAILED DESCRIPTION OF THE PREFERRED EMBODIMENTS

Figure 1:
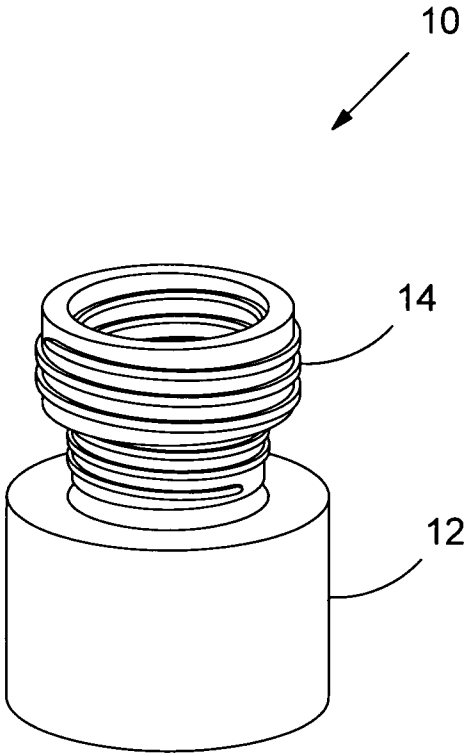
FIG. 1 is a perspective view illustrating a bottle coupling device, constructed in accordance with the present invention, with a male coupling connecting to a female coupling.
Figure 2:
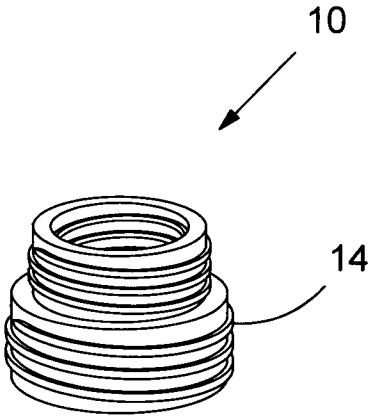
FIG. 2 is a perspective view illustrating the male coupling of the bottle coupling device, constructed in accordance with the present invention.
Figure 3:
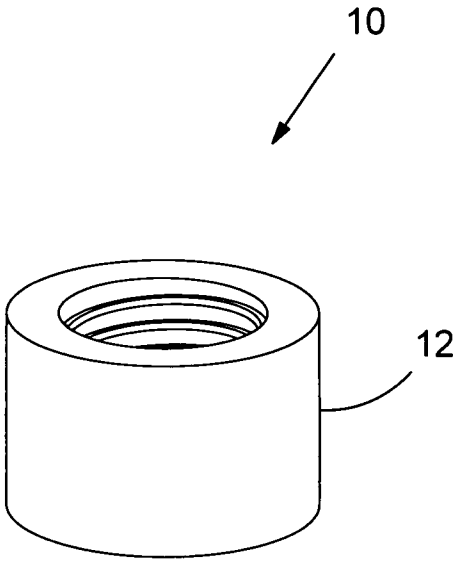
FIG. 3 is a perspective view illustrating the female coupling of the bottle coupling device, constructed in accordance with the present invention.
Figure 5:
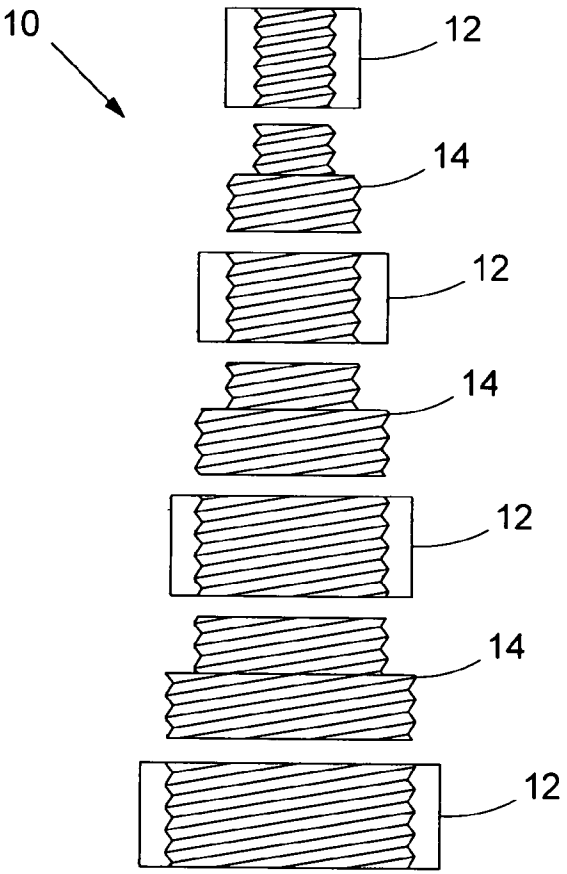
FIG. 5 is a perspective view illustrating a plurality of connectable male couplings and female couplings of the bottle coupling device, constructed in accordance with the present invention.
Figure 4:
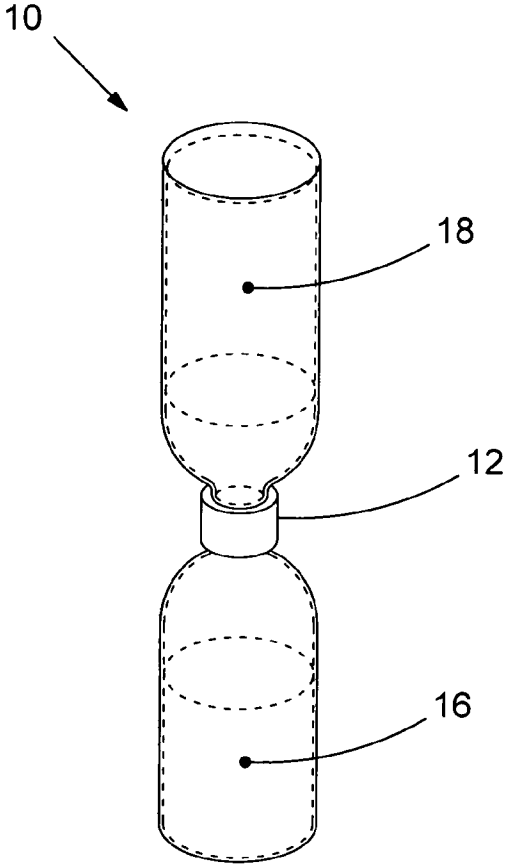
FIG. 4 is a perspective view illustrating the bottle coupling device, constructed in accordance with the present invention, with the bottle coupling device coupling together a draining bottle and a receiving bottle.

As illustrated in FIGS. 1-5, the present invention is a bottle coupling device, indicated generally at 10, providing a threaded female coupling 12 and a threaded male coupling 14 configured to easily connect two bottles 16, 18 together thereby serving as a funnel through which the remnants of various household products and other liquids can be easily transferred from a nearly empty container to one which can be topped off. The bottle coupling device 10 of the present invention is preferably cylindrical in shape and offered in a range of sizes to accommodate various applications.

The male coupling 14 of the bottle coupling device 10 of the present invention has a first end and a second end. Preferably, the male coupling 14 has a threaded outer surface and a threaded inner surface. In addition, preferably, the first end of the male coupling 14 has a diameter different than a diameter of the second end of the male coupling 14. In an embodiment of the present invention, the diameter of the first end of the male coupling 14 is less than the diameter of the second end of the male coupling 14.

The female coupling 12 of the bottle coupling device 10 of the present invention has a first end and a second end. Preferably, the female coupling 12 has a smooth outer diameter and a threaded inner diameter. In addition, the first end of the female coupling 12 and the second end of the female coupling 12 have equal diameters.

There are multiple combinations for using the male coupling 14 and the female coupling 12 of the bottle coupling device 10 of the present invention. First, the female coupling 12 can be used alone to couple together the two bottles 16, 18 having openings with the same diameter. Second, the second end of the male coupling 14 and either the first or second end of the female coupling 12 can threaded together to couple together the two bottles 16, 18 having openings with different diameters. Third, a plurality of male couplings 14 and/or female couplings 12 can be coupled together to couple together the two bottles 16, 18 having openings with a large difference in the diameters of the openings. As stated, both the first end and the second end of the inner surface of the female coupling 12 have female threads for use in securing the coupling to the threaded opening of two of the same size bottle openings thereby joining the two bottles 16, 18 at their respective openings. Also, the female coupling 12 can be used along with the male coupling 14 that also has both male and female threads so two bottles with different size bottle openings can potentially be joined together at their respective openings. The interior of the male coupling 14 and the female coupling 12 are an open funnel, thus, when properly connected together via the female coupling 12 and/or the combined male coupling 14 and female coupling 12, one bottle 16 sits upright, with the second bottle 18 hovering upside down over the first, thereby allowing gravity to pull the liquid matter from the second bottle 18 into the first bottle 16. The male coupling 14 and the female coupling 12 can be packaged and sold individually, or in packages of several units per container.

A standard version of the bottle coupling device 10 of the present invention for use with lotion bottles and comparably sized containers preferably measures between 1.5 inches to 1.75 inches in height, 1.5 inches to 1.75 inches in depth, with the wall thickness of the unit measuring 0.125 inches. In addition, this version of the coupling measures 3.925 inches in circumference.

The manner of use of the bottle coupling device 10 of the present invention will now be described. It will be understood by those skilled in the art that the manner of use of the bottle coupling device 10 described herein is merely one method of use and other methods of use of the bottle coupling device 10 are within the scope of the present invention.

Use of the bottle coupling device 10 of the present invention is very simple and straight forward. The user purchases individual male couplings 14 and female couplings 12 in accordance with the many various sized shampoo, soap, condiment and other dispenser bottles they might have around the house. The user then uses these products per normal, until the bottle has been nearly emptied of its contents. The user then removes the existing cap from the bottle that can be topped off, screwing the first end of the female coupling in its stead. Next, the user removes the cap from the nearly empty bottle, securing the second end of the female coupling 12 located on the opposite end of the female coupling 12 to the mouth of the bottle 18. The user then sets the new bottle 16 of product in the upright position on any table top or flat surface, thus the nearly empty bottle 18 is inverted over it and connected to it, enabling the liquid from the nearly empty bottle to drip into the fuller bottle 16 by the simple force of gravity. After all liquid had been pulled from the empty bottle 18, the user removes the female coupling 12 and discards that bottle 18 in any trash receptacle or recycle bin. The user can wash the female coupling 12, storing the unit away until it is needed again. If the bottles 16, 18 have different sized openings, one or more male couplings 14, together with one or more female couplings 12 can be used.

The bottle coupling device 10 of the present invention offers users many significant benefits and advantages. Foremost, the bottle coupling device 10 enables users to utilize every drop of purchased liquid goods. A coupling that joins two bottles together, enabling the user to transfer product from one bottle to the next, the bottle coupling device 10 eliminates the costly waste of expensive household goods. Preventing the wasteful practice of discarding bottles of product before they had been completely emptied, simply because these bottles are difficult to squeeze or pump, use of the bottle coupling device 10 ensures that the user can quickly and efficiently retrieve the last few squirts of liquid from the bottom of the container. Because of this, users utilizing the bottle coupling device 10 save money. Versatile, the bottle coupling device 10 is well suited for use with a variety of containers including but not limited to: hair care products, detergents, liquid soaps, motor oil and bottles containing food condiments. Manufactured in a wide array of sizes and configurations, there is an individual bottle coupling device 10 suitable for use with virtually any liquid container. Although designed with the home user in mind, the bottle coupling device 10 is particularly well suited for use by hair stylists, maintenance workers and restaurateurs. Enabling these professionals to efficiently utilize entire bottles of shampoos, liquid cleansers, or food condiments, use of the bottle coupling device 10 reduces waste and ensure greater profit potential.

The bottle coupling device 10 of the present invention enables users to efficiently utilize the entire contents of any purchased bottle of shampoo, detergent or similar viscous fluid. Saving users countless dollars spent on replacement products, the bottle coupling device 10 proves an invaluable accessory in any household.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A bottle coupling device for connecting a first bottle to a second bottle, the first bottle having a first threaded opening, the second bottle having a second threaded opening, the first bottle holding a first substance, the second bottle holding a second substance, the bottle coupling device comprising:

a hollow female coupling having an outer surface and an inner surface, the female coupling having a first end and a second end, the inner surface of the first end being threaded, the inner surface of the second end being threaded;

wherein the first opening of the first bottle is threadably connectable to the first end of the female coupling;

wherein the second opening of the second bottle is threadably connectable to the second end of the female coupling; and wherein upon threadably connecting the first threaded opening of the first bottle to the first end of the female coupling and the second threaded opening of the second bottle to the second end of the female coupling, the second substance is transferrable to the first bottle through the female coupling further comprising:

a hollow male coupling having an outer surface and an inner surface, the male coupling having a first end and a second end, the inner surface and the outer surface of the first end of the male coupling being threaded, the inner surface and the outer surface of the second end of the male coupling being threaded;

wherein the first end of the female coupling is connectable to the first threaded opening of the first bottle, the first end of the male coupling is connectable to the second end of the female coupling, and the second end of the male coupling is connectable to the second threaded opening of the second bottle; and wherein the second substance is transferrable to the first bottle through the connected female and male coupling.

2. The bottle coupling device of claim 1 wherein the first end of the male coupling has a diameter different than a diameter of the second end of the male coupling.

3. The bottle coupling device of claim 2 wherein the diameter of the first end of the male coupling is less than the diameter of the second end of the male coupling.

4. The bottle coupling device of claim 2 wherein the diameter of the second end of the male coupling is less than the diameter of the first end of the male coupling.

5. The bottle coupling device of claim 1 and further comprising:

a plurality of female couplings;

a plurality of male couplings;

wherein the female couplings and the male couplings are alternating connected together.

6. A bottle coupling device for connecting a first bottle to a second bottle, the first bottle having a first threaded opening, the second bottle having a second threaded opening, the first bottle holding a first substance, the second bottle holding a second substance, the bottle coupling device comprising:

a hollow female coupling having an outer surface and an inner surface, the female coupling having a first end and a second end, the inner surface of the first end being threaded, the inner surface of the second end being threaded, the first end of the female coupling being the same size as the second end of the female coupling, the threads of the first end and the second end of the female coupling being the same; and a hollow male coupling having an outer surface and an inner surface, the male coupling having a first end and a second end, the inner surface and the outer surface of the first end of the male coupling being threaded, the inner surface and the outer surface of the second end of the male coupling being threaded;

wherein the first end of the female coupling is connectable to the first threaded opening of the first bottle, the first end of the male coupling is connectable to the second end of the female coupling, and the second end of the male coupling is connectable to the second threaded opening of the second bottle; and wherein the second substance is transferrable to the first bottle through the connected female and male coupling.

7. The bottle coupling device of claim 6 wherein the female coupling has a substantially cylindrical shape.

8. The bottle coupling device of claim 6 the inner surface of the female coupling is continuously threaded from the first end to the second end.

9. The bottle coupling device of claim 6 wherein the first end of the male coupling has a diameter different than a diameter of the second end of the male coupling.

10. The bottle coupling device of claim 9 wherein the diameter of the first end of the male coupling is less than the diameter of the second end of the male coupling.

11. The bottle coupling device of claim 9 wherein the diameter of the second end of the male coupling is less than the diameter of the first end of the male coupling.

12. The bottle coupling device of claim 6 and further comprising:

a plurality of female couplings;

a plurality of male couplings;

wherein the female couplings and the male couplings are alternating connected together.

* * * * *